US005460419A

United States Patent [19]

Castoldi

[11] Patent Number: 5,460,419

[45] Date of Patent: Oct. 24, 1995

[54] HANDLE-LOCK DEVICE FOR EITHER PRESSURE OR TRACTION OPENING OF DOORS

[75] Inventor: Alberto Castoldi, Mariano Comense, Italy

[73] Assignee: Cas Di A.A. Campi S.p.A., Milan, Italy

[21] Appl. No.: 253,242

[22] Filed: Jun. 2, 1994

[30] Foreign Application Priority Data

Dec. 30, 1993 [IT] Italy ..... MI93A2769

[51] Int. Cl.[6] ..... L05B 3/00

[52] U.S. Cl. ..... 292/336.3; 292/169; 292/175

[58] Field of Search ..... 292/336.3, DIG. 30, 292/165, 169, 175

[56] References Cited

U.S. PATENT DOCUMENTS

| | | | |
|---|---|---|---|
| 2,153,827 | 4/1939 | Ferris | 292/166 |
| 2,233,278 | 2/1941 | Aldeen | 292/191 |
| 2,483,368 | 10/1949 | Ledin | 292/165 |
| 2,542,130 | 2/1951 | Friend | 292/174 |
| 3,024,055 | 3/1962 | Novarino | 292/169 |
| 3,201,161 | 8/1965 | Castle | 292/165 |
| 3,495,861 | 2/1970 | Snow | 292/74 |
| 4,243,256 | 1/1981 | Frydrych | 292/169 |
| 4,589,691 | 5/1986 | Foshee | 292/165 |
| 4,629,228 | 12/1986 | Marko et al. | 292/165 |
| 4,871,202 | 10/1989 | Friedrichs et al. | 292/169 |
| 4,974,883 | 12/1990 | Jans | 292/169 |
| 5,020,836 | 6/1991 | Su | 292/165 |

FOREIGN PATENT DOCUMENTS

| | | |
|---|---|---|
| 1340935 | 9/1963 | France . |
| 1483125 | 4/1967 | France . |
| 258824 | 9/1912 | Germany . |

*Primary Examiner*—Peter M. Cuomo
*Assistant Examiner*—Monica E. Millner
*Attorney, Agent, or Firm*—Burns, Doane, Swecker & Mathis

[57] ABSTRACT

The latch or bolt (4) of a door lock is engaged and driven by a finger (24) on a control arm (22), pivoted on a pin (20) fixed to the case (12) of the lock. The control arm is driven by a cylindrical sliding member (36) engaging a tab (32) thereof; this member in turn is driven against a spring action (40) along a fixed guide shaft (38), which is coaxial to it, by a control lever (42) hinged on a fixed pin (44) in the lock case, whose axis intersects the axis of the cylindrical sliding member. Control lever head (42') is sufficiently extended to engage two diametrically opposite parts of the cylinder, in rest position.

10 Claims, 3 Drawing Sheets

HANDLE-LOCK DEVICE FOR EITHER PRESSURE OR TRACTION OPENING OF DOORS

BACKGROUND AND SUMMARY OF THE INVENTION

The invention refers to the field of door-locks or open-close devices for doors or door panels. Various types of locks meeting various requirements are well-known. Recent examples are knob and button locks, commonly used in public facilities; said locks include a fixed knob on the upper face of which is situated a button which, in its raised position, extends the bolt, therefore effecting door closure, in its depressed or lowered position, acts upon the bolt by means of a fork member, thereby driving it back to its housing, which operation generally opens the door.

Although such locks are widely used, they have the drawback that they can be engaged only when one's hand is free; if the user's hands are engaged, as when carrying something, he must first set down what he is carrying before grasping the knob and disengaging the lock.

Therefore, the aim has been to devise a lock system which can be easily operated both by pushing and pulling, not only with a free hand, but also by using one's elbow, shoulder or knee, so that the user can operate the door-lock mechanism even when his hands are otherwise occupied, such as when carrying things.

Said objectives have been achieved with a lock as outlined in the following description.

This new door lock comprises a control or operating arm, pivotably mounted on a pin fixed to the lock case, said arm having a finger extending into an aperture of the latch or bolt, so that pivoting of said control arm around its pin causes movement which then releases the bolt. Forward movement (door closed) is caused by return springs, with which both the lock and latch are fitted, said control arm being spring-biassed in a position, an arm operating member being slidingly mounted for a length along an axis perpendicular to said control arm pin, said operating member having an operating surface cooperating with a nib of the control arm, said member being spring-driven to an extended or rest (door closed) position; a second pin fixed with respect to the lock case and having an axis which is transversal to that of the operating member and preferably coplanar and perpendicular to it, there being mounted on said pin a pivotable control lever. The lever is engaged by a control handle, pivoted on the lock case along an axis parallel to that of the lever pin. A lock system, securing the latch in closed position, has a mobile tab rotating between a locked position, where it engages a groove on the latch control arm thereby immobilizing it, and an unlocked position, wherein it is retracted out of said groove.

This new lock device is easy and smooth to operate, rarely jams, can be operated either by pushing or pulling on the handle, and therefore can be opened with an arm or shoulder, or similarly even by a user whose hands are engaged.

BRIEF DESCRIPTION OF THE DRAWING FIGURES

A more detailed description of the invention will be provided further on, in an illustrative and not limitative way, with reference to the herein enclosed figures, where:

DETAILED DESCRIPTION OF PREFERRED EMBODIMENTS

Figure 1:
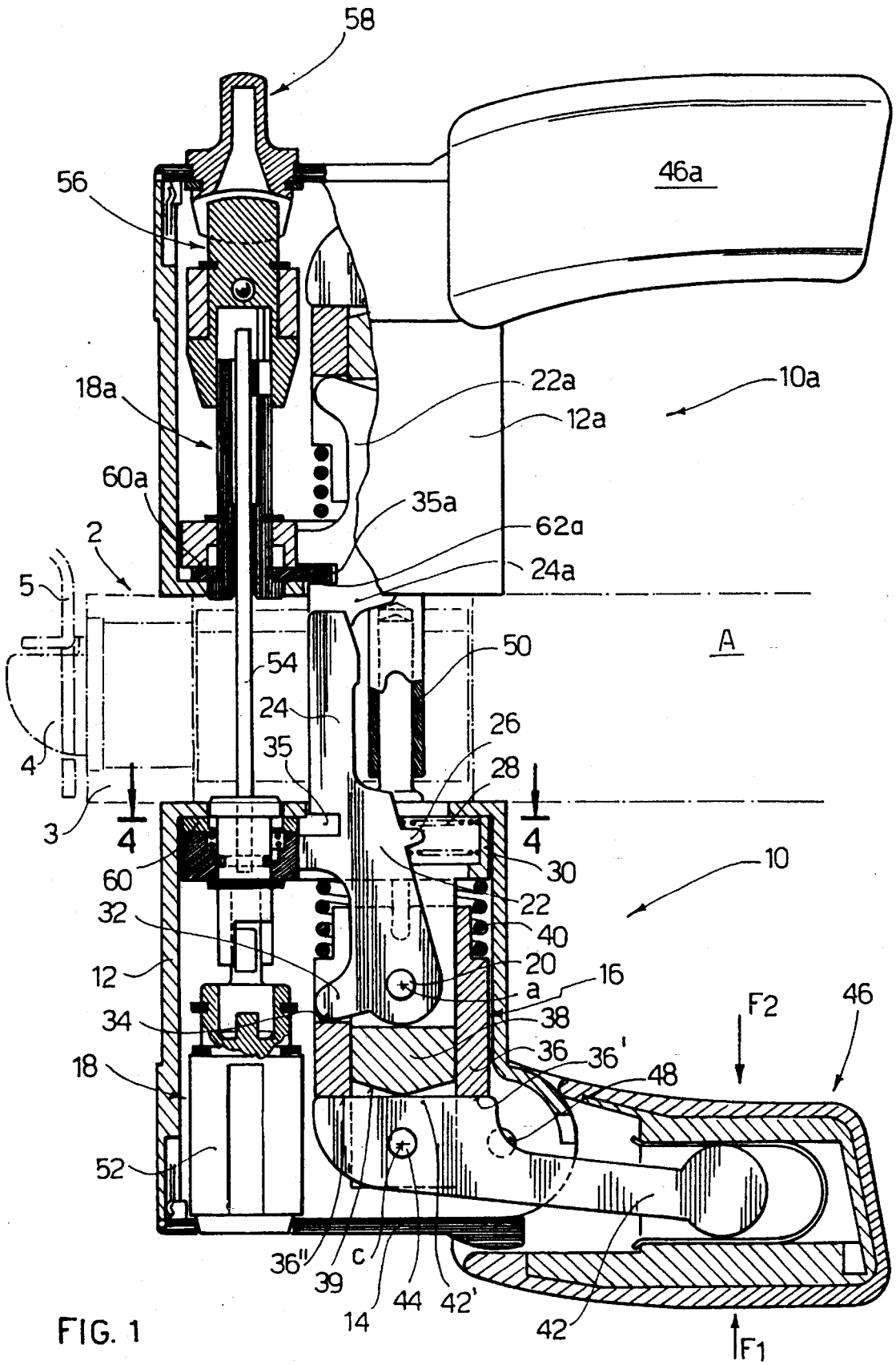
FIG. 1 is a sectional view taken along a horizontal plane indicated as 1—1 in FIG. 3, through a lock, as per the present invention; two cooperating lock units are shown, one on each door side; the door and the bolt are drawn by dash-dot lines; the door lock is shown in locked closed position with the bolt in its extended locked position.
Figure 2:
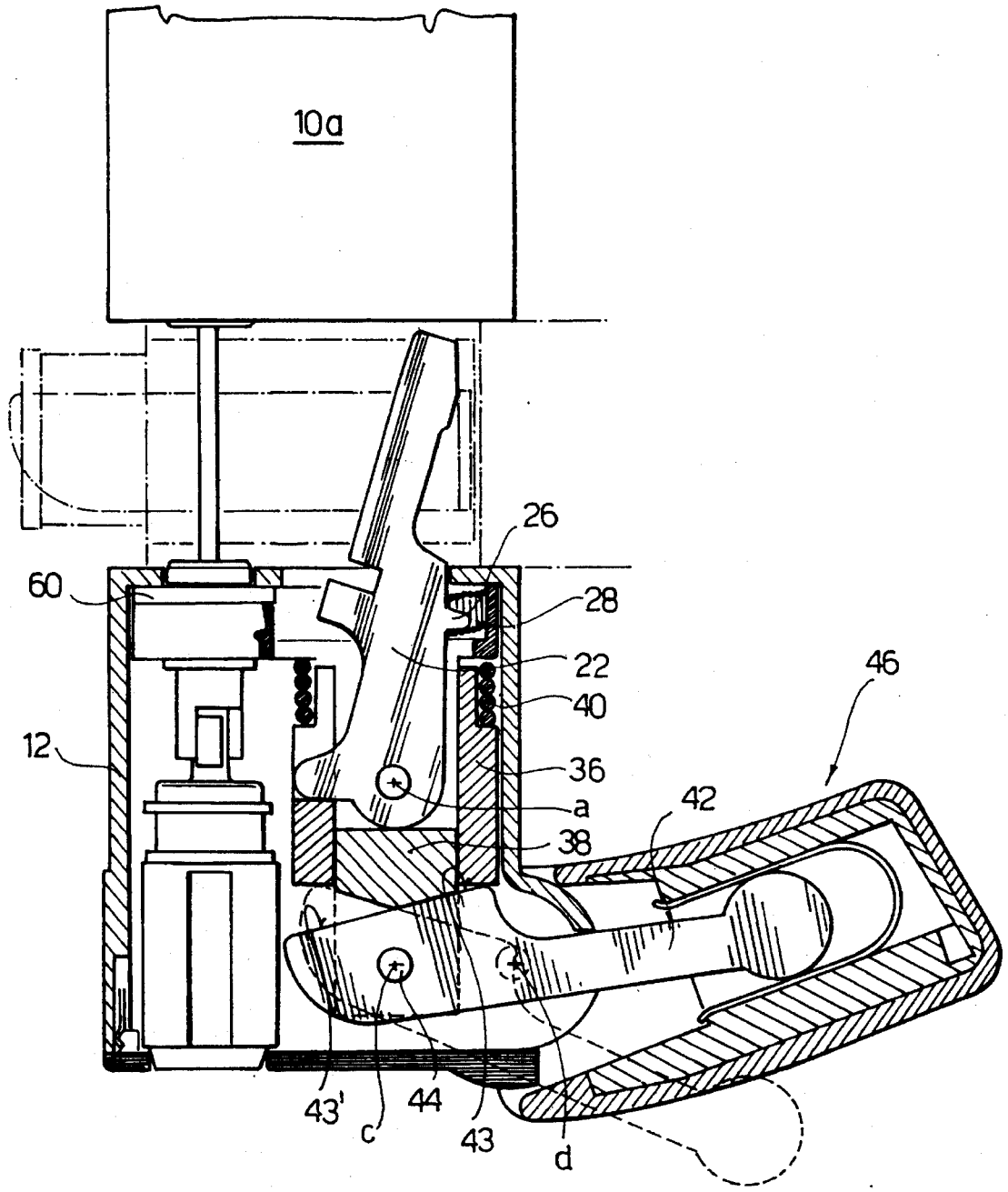
FIG. 2 is a sectional view similar to the one shown in FIG. 1, in an open door position, that is, with the bolt retracted; only one lock unit is shown; the handle and the lever are indicated by a continuous line in a condition when door opening is obtained by pressure; by a dotted line when door opening is obtained by traction.

First of all, in reference to FIG. 1, letter A indicates a panel, generally of a door, fitted with a spring-lock device inclusively indicated as 2, which comprises a housing 3 and a spring-lock or dead bolt 4; the latter slides in said housing between an extended position, shown in FIG. 1, wherein it is engaged in an engaging member 5 in a fixed frame, and a retracted position, shown in FIG. 2, where it is virtually completely housed in housing 3 and does not engage the engaging member of the fixed frame.

Door panel A is fitted with two bolt control lock units, indicated as 10 and **10*a*. Herein only unit 10 is described; parts of unit 10*a* corresponding in shape and function to those of unit 10** have the same references with index a, and will not be described in detail.

As per this invention, bolt control lock unit 10 includes a box or case 12, and a lid 14. The case houses a bolt driving device, inclusively indicated as 16, and a bolt locking device, inclusively indicated as 18. In greater detail, a first pin 20, fixed to the case, is fitted with a swivel bolt control arm indicated as 22. The latter has a distal part comprising a finger 24 that catches in a groove transversal to the bolt, so that clockwise swiveling motion of the arm around pin 20 in FIG. 1 causes finger 24 to draw the bolt towards the right in FIG. 1, thus placing it in the opening or retracted position. Arm 22 has a guide prong 26 for a return spring 28 which, in this specific case, is a helical pressure spring housed in a housing 30 in the case and positioned with its axis basically parallel to the bolts movement. A nib 32 juts from the lever 22 as a part of it and engages a control or operating surface of an arm operating member inclusively indicated by number 36, which will be better described further on. Member 36 is a generally cylindrical element, with axis b, capable of sliding along axis b and guided along a so-called guide arbor or shaft 38, fixed to the case. Although hereafter member 36 is referred to as a cylinder, it must be understood that it can have any shape, provided it comprises two surfaces 36', 36" diametrically opposite with respect to axis b. Preferably, but not necessarily, axis b is orthogonal to axis a of pin 20.

Operating cylinder 36, therefore, slides between a retracted rest or closed position, shown in FIG. 1, where it is spring-biassed by spring 40, and an extended or opening position, shown in FIG. 2, where it is pushed against the action of spring 40 and, in turn, pressing with surface 34 against nib 32, causes the arm 22 to rotate.

Preferably, the fixed body or shaft 38 has an end double-incline surface 39, the reason for which will be clarified further on.

Cylinder 36, in turn, is operated by means of a lever 42, which is pivoted on an axis c fixed to the case, by means of a pivot indicated as 44. Lever 42 has a widened head 42' which engages two diametrically opposite surfaces 36', 36" of cylinder 36 in rest position; lever 42 has a part remote from the pivot engaged in an oscillating handle 46, pivoted in turn on the case, or body 12, of the lock along an axis d parallel to that of pin 44 and, in practice, by means of two pins 48 aligned on said axis and laterally placed on said case 12. Given the aforementioned explanation, it should be clear that, by depressing handle 46 in the direction of arrow F1, starting from the rest position shown in FIG. 1, one has the position as indicated by continuous line in FIG. 2, in which surface 43 of head 42' of lever 42 presses on cylinder 36, against the bias of spring 40 (the movement of the lever 42 being limited by surface 39), thus shifting cylinder 36 upwards in FIG. 1; surface 34 engages and acts on nib 32, which forces lever 22 to rotate clockwise against the bias of spring 28, after which lever finger 24 shifts towards the right drawing bolt 4 into its housing. When force F1 on handle 46 is released, springs 28 and 40 drive the various components to the situation of FIG. 1. It will be noticed that when exerting force F2 opposite to F1 on handle 46, part 43' of head 42' of lever 42 is set in motion (position outlined in FIG. 2), but for the rest, movement of members 36 and 22 is as previously described with reference to FIG. 1.

Furthermore, the lock comprises a coupling lockpin 50 for coupling with lock unit 10*a* on the other side of the door. This other lock unit has a finger 24*a* of lever 22*a* housed on a staggered plane with respect to finger 24 of lever 22 just described in particular, under lever 24 in FIG. 1. The bolt as it should be noticed, can be driven by either one finger 24 or the other 24*a;* finger 24 or 24*a,* which at that moment is not operated, can shift together with the bolt against the action of spring 28 without involving other parts in its movement.

Figure 4:
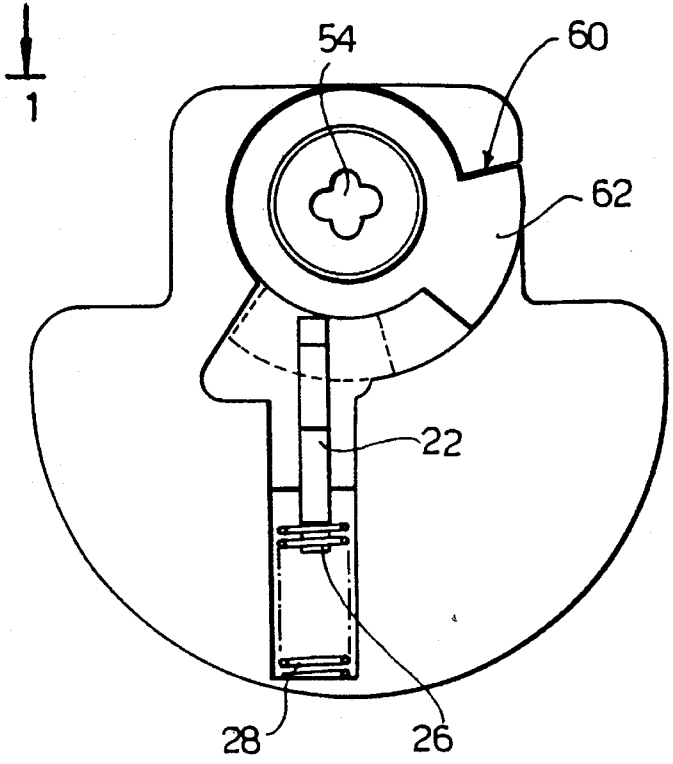
FIG. 4 is a sectional view along plane 4—4 of FIG. 1.
Figure 3:
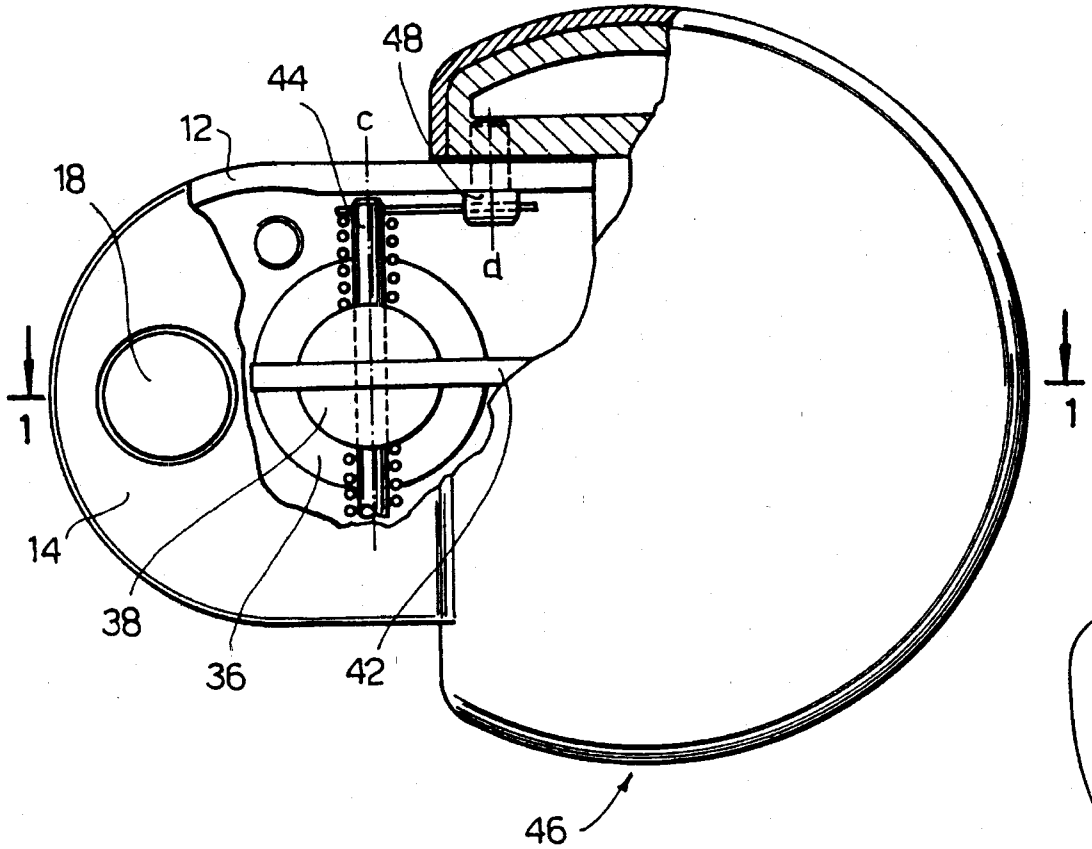
FIG. 3 is a bottom view with respect to FIG. 1, with part of the handle removed.

Preferably, the case of one or both lock units also comprises a key-lock device indicated by 18 and 18*a* respectively, for example, it can comprise a barrel-cylinder device 52, of any known type, which rotates a rod 54, extending to the other device 52*a* of lock 10*a* and which, at the end thereof, is housed in a per se known end device 56, operable by means of a knob 58 in an open or closed position, or in another key-lock cylinder (not shown). These parts are not described in detail. Rod 54 has a non-circular sectional shape engaging a locking plate indicated as 60 for unit 10 and a plate 60*a* for device 10*a*. The plate has a locking tab 62 (respectively 62*a*) extended along a part of circle ring, as is better shown in FIG. 4. In the position shown in FIG. 4, tab 62 is in a free position far from arm 22, while, in the locking position shown with a dotted line, the tab engages a cavity 35 (respectively 35*a*) of arm 22 (or 22*a*), preventing the latter from oscillating to any degree out of the position shown in FIG. 1. The action of plate 60 or 60*a* is sufficient to lock the bolt. Only one unit 10 can be mounted on door panel A, instead of two; or one or both units 10, 10*a,* may lack locking device 18 or 18*a*.

Obviously, variations and modifications can be made to what has been described, whereby is meant that all variations and modifications accessible to a technician familiar with this specific field, and who has read the present description, must be understood to fall within the scope of the present invention.

What is claimed is:

1. A handle-lock device for operating a bolt slidably mounted for movement in a panel between an extended, locked position and a retracted, open position, the device comprising:

a case mountable on a panel;

a bolt control arm pivotally mounted in the case for controlling movement of the bolt, the control arm having a bolt engaging portion extending from the case to the bolt and having a nib, the bolt control arm being pivotable between a first position where the bolt is extended and a second position where the bolt is retracted by the control arm;

a control arm operating member slidably mounted in the case for movement between a first and second position, and having a control surface for engagement with the nib, and two, spaced apart actuating surfaces;

a lever pivotally mounted in the case on a lever axis and having a head engaging the spaced apart actuating surfaces on opposite sides of the lever axis, the lever being pivotable about the lever axis in opposite directions from a neutral position, wherein pivoting movement of the lever causes the head to push against one of the spaced apart actuating surfaces to move the control arm operating member; and a spring system disposed in the case for biasing at least one of the control arm in the first position and control arm operating member in the first position.

2. A handle-lock device as claimed in claim 1, further comprising a guide body mounted in the case adjacent to the spaced apart actuating surfaces, the guide body having a V-shaped surface facing the head of the lever, wherein the V-shaped surface limits the pivoting movement of the lever.

3. The handle-lock device as claimed in claim 2, wherein the guide body is mounted in the case so that an apex of the V-shaped surface is substantially aligned with the lever axis.

4. A handle-lock device as claimed in claim 1, further comprising a handle pivotally mounted to the case at a handle axis parallel to the lever axis, the handle being coupled to the lever to drive the lever.

5. The handle-lock device as claimed in claim 1, wherein the spring system comprises a coil spring disposed in the case to bias the control arm operating member to the first position.

6. The handle-lock device as claimed in claim 1, wherein the spring system comprises a coil spring disposed in the case to bias the control arm to the first position.

7. The handle-lock device as claimed in claim 1, further comprising a bolt locking device comprising a rotatable rod mounted in the case, the rotatable rod having a plate mounted thereon for rotation with the rod, the plate having a tab extending therefrom, wherein the bolt control arm has a seat facing the plate, the tab being movable by rotation of the rod to a position contained in the seat.

8. The handle-lock device as claimed in claim 1, wherein the bolt is movable in a panel defined by a first plane and the lever is movable in a second plane substantially perpendicular to the first plane.

9. The handle-lock device as claimed in claim 8, wherein the lever is pivotable in a direction toward the first plane and in a direction away from the first plane.

10. The handle-lock device as claimed in claim 1, wherein the head of the lever includes a substantially planar face extending to opposite sides of the lever axis, the face contacting the spaced apart actuating surfaces on opposite sides of the lever axis.

* * * * *